US005660073A

United States Patent [19]

McBroom et al.

[11] Patent Number: 5,660,073

[45] Date of Patent: Aug. 26, 1997

[54] APPARATUS AND METHOD FOR FORMING A BALL OF RELATIVELY SMALL DIAMETER

[75] Inventors: Michael R. McBroom, Oneida, Tenn.; Willard A. Farley, Plainville, Ind.

[73] Assignee: MCM Corporation of Oneida, Oneida, Tenn.

[21] Appl. No.: 493,005

[22] Filed: Jun. 21, 1995

[51] Int. Cl.[6] ..... B21D 43/28; B21H 1/14

[52] U.S. Cl. ..... 72/337; 72/339; 72/361; 72/294; 83/150; 83/694

[58] Field of Search ..... 72/336, 335, 337, 72/339, 294, 318, 360, 361, 356; 140/71 R; 470/95, 109, 154; 83/150, 694

[56] References Cited

U.S. PATENT DOCUMENTS

| | | | |
|---|---|---|---|
| 1,573,487 | 2/1926 | Gorman | 72/377 |
| 1,857,997 | 5/1932 | Brennan | 72/337 |
| 1,897,359 | 2/1933 | Brennan | 72/337 |
| 2,132,853 | 10/1938 | Kearney | 72/337 |
| 2,800,814 | 7/1957 | Lewis | 72/339 |
| 4,023,393 | 5/1977 | Messerschmidt | 72/337 |
| 4,044,588 | 8/1977 | Haines | 72/337 |
| 4,505,144 | 3/1985 | Sakuma | 72/356 |

*Primary Examiner*—Daniel C. Crane
*Attorney, Agent, or Firm*—Paul E. Hodges, P.C.

[57] ABSTRACT

An apparatus and method for forming a ball of relatively small diameter from metal wire includes a cutoff bar and a slide mechanism for shearing a length of metal wire from the remainder thereof at a first station to provide a blank with which a ball is subsequently formed and for transporting the blank to a second station and also includes a specially-designed punch assembly for forming the blank into a ball at the second station. The punch assembly includes a main slide body and a blank-engaging plunger assembly slidably mounted on the main slide body for sliding movement therealong wherein the plunger which is biased, by air pressure, from a retracted position to an extended position relative to the main slide body. As the plunger assembly is advanced toward the blank at the second station, the air-biased plunger assembly halts momentarily upon engagement with the blank, and it is during this momentary halt in the advancement of the plunger assembly that the cutoff bar and slide mechanism are begun to be moved away from the work axis to out-of-the-way positions accommodating the subsequent pressing of the blank into a ball by the punch assembly without interference from the cutoff bar and slide mechanism.

8 Claims, 11 Drawing Sheets

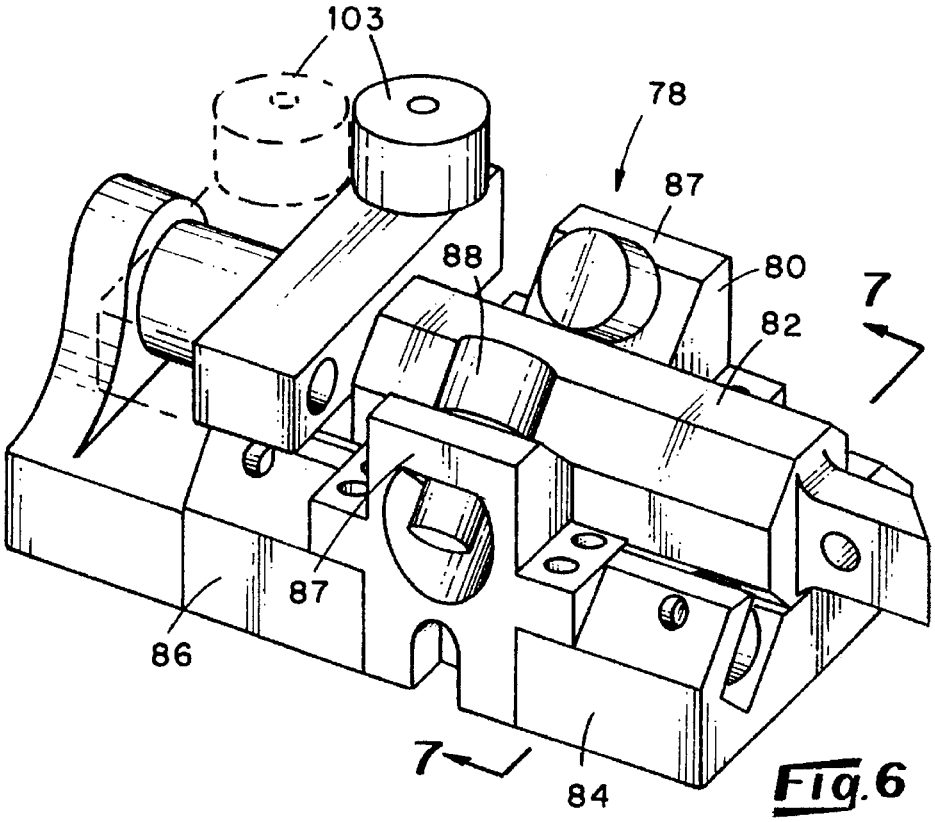
Fig.6
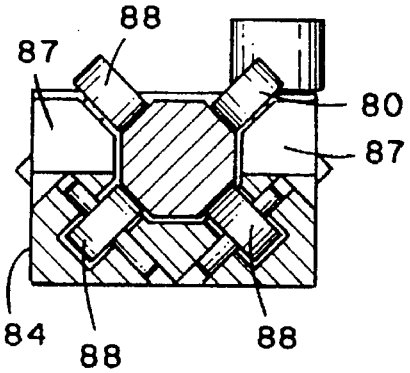
Fig.7
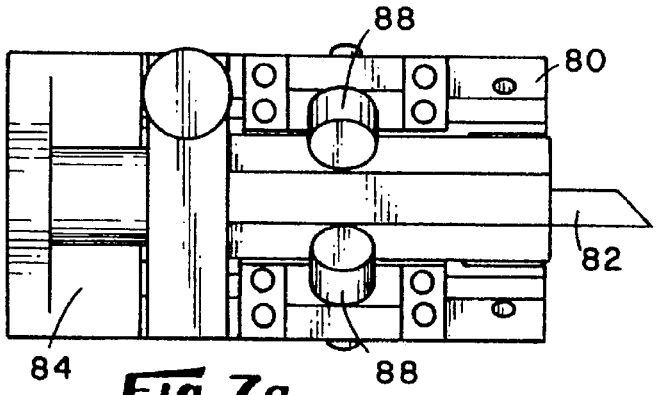
Fig.7a
Fig.7B
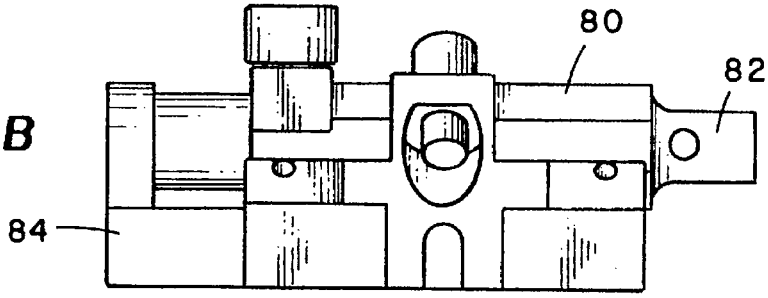

APPARATUS AND METHOD FOR FORMING A BALL OF RELATIVELY SMALL DIAMETER

BACKGROUND OF THE INVENTION

This invention relates generally to the forming of metal balls and relates, more particularly, to the cold-forming of a metal ball of relatively small diameter.

Common methods for cold-forming a metal ball involve a shearing of a blank (or slug) from a length of wire stock and subsequently forming the blank, in a die-press operation, into a substantially spherical shape. Heretofore, however, the means and methods for forming such a ball have not been able to accommodate high-speed production at a rate in excess of about 600 parts per minute.

It is an object of the present invention to provide a new and improved means and method for cold-forming balls of relatively small diameter.

Another object of the present invention is to provide such means and method which accommodate high-speed production of balls at a rate appreciably above 600 parts per minute.

Yet another object of the present invention is to provide such a means which is capable of producing metal balls which are relatively clean and trash-free and whose dimensions are highly accurate.

A further object of the present invention is to provide such a means which is effective in operation and which can be cleaned and maintained with relative ease.

SUMMARY OF THE INVENTION

This invention resides in an apparatus for forming a metal ball of relatively small diameter from metal wire and an associated method.

The apparatus of the invention includes means situated at a first station for holding a length of metal wire in a condition to be sheared from the remainder thereof and means supported adjacent the first station for shearing the length of wire from the remainder thereof to provide a blank with which a ball is subsequently formed and for transporting the blank to a second station. Pressing means are supported adjacent the second station for pressing the blank into a ball wherein the pressing means includes a stationary die mounted at the second station and a punch assembly which cooperates with the die for forming the blank into a ball as the blank is pressed between the punch assembly and the die. The punch assembly includes a slide member mounted for movement toward and away from the die along a work axis and a plunger assembly for engaging the blank during the formation of the blank into a ball wherein the plunger assembly is carried by the slide member toward and away from the die and is movably supported by the slide member for movement relative thereto along the work axis between one condition at which the plunger assembly is in an extended position relative to the slide member and another condition at which the plunger assembly is in a retracted position relative to the slide member.

The apparatus also includes means for moving the slide member along the work axis toward the die, and means for displacing the blank shearing and transporting means away from the work axis following the transport of the blank to the second station so that the blank shearing and transporting means is moved to an out-of-the-way position at which it does not interfere with the formation of the blank into a ball by way of the pressing means. Means are also provided for biasing the plunger assembly from its retracted position relative to the slide body toward its extended position relative thereto so that as the slide body is moved toward the die along the work axis and the plunger assembly is arranged in its extended position relative to the slide body, the plunger assembly contacts the blank so that the advancement of the plunger assembly toward the die is halted in opposition to the force of the biasing means until the continued movement of the slide member toward the die moves the slide body and plunger assembly into the aforesaid retracted relationship, at which moment the plunger assembly is again advanced toward the die by way of the slide body to form the blank into a ball. Furthermore, the means for moving the slide body toward the die is coordinated with the means for displacing the blank shearing and transporting means away from the work axis so that the displacement of the blank shearing and transporting means away from the work axis as aforesaid is initiated during the period that the advancement of the plunger assembly toward the die is halted.

The method of the invention includes the steps performed by the apparatus of the invention. In particular, the method includes the steps of holding a length of metal wire in a condition to be sheared from the remainder thereof, shearing the length of wire from the remainder thereof to provide a blank with which a ball is subsequently formed, and transporting the blank to the second station by way of the blank-transporting means. The slide body is then moved along the work axis toward the die while the plunger assembly is arranged in its extended condition relative to the slide body so that the plunger assembly contacts the blank which, in turn, halts the advancement of the plunger assembly until the continued movement of the slide body toward the die moves the slide body and plunger assembly into the aforesaid retracted position and the blank is subsequently pressed by the plunger assembly into a ball. In addition, the blank-transporting means is displaced from the work axis following the transport of the blank to the second station in coordination with the step of moving the slide body toward the die so that the displacing step is initiated during the period that the advancement of the plunger assembly toward the die is halted.

BRIEF DESCRIPTION OF THE DRAWINGS

FIG. 6 is a perspective view of the carryover assembly of the FIG. 2 apparatus.

FIG. 7 is a cross-sectional view taken about along line 7—7 of FIG. 6.

FIG. 7*a* is a plan view of the carryover assembly illustrated in FIG. 6.

FIG. 7*b* is a side elevational view of the carryover assembly of FIG. 7 as seen from below in FIG. 7*a*.

DETAILED DESCRIPTION OF THE ILLUSTRATED EMBODIMENT

Figure 1:
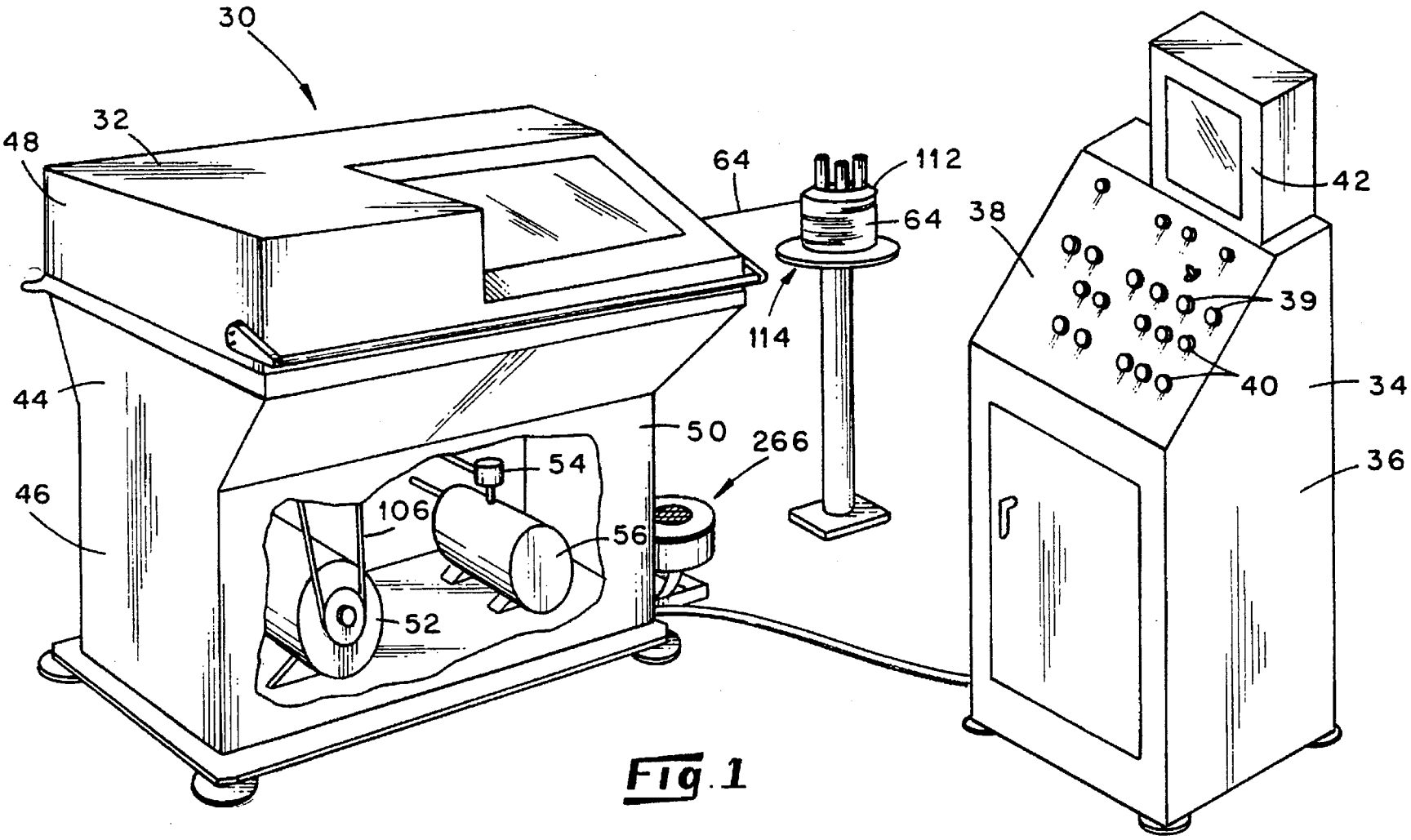
FIG. 1 is a perspective view, shown partially cut-away, illustrating a system within which features of the present invention are embodied.

Turning now to the drawings in greater detail and considering first FIG. 1, there is shown an embodiment, generally indicated 30, of a system for forming metal balls of relatively small diameter. The system 30 includes an apparatus 32 within which blanks (or slugs) are sheared from wire stock and subsequently formed into balls and a control center 34 at which the operations of the apparatus 32 are controlled. In the depicted system 30, the control center 34 includes a cabinet 36 having a control panel 38 upon which a plurality of switches 39 and indicator lights 40 are mounted and a display panel 42 for providing a visual display of selected operating characteristics of the apparatus 32.

Figure 2:
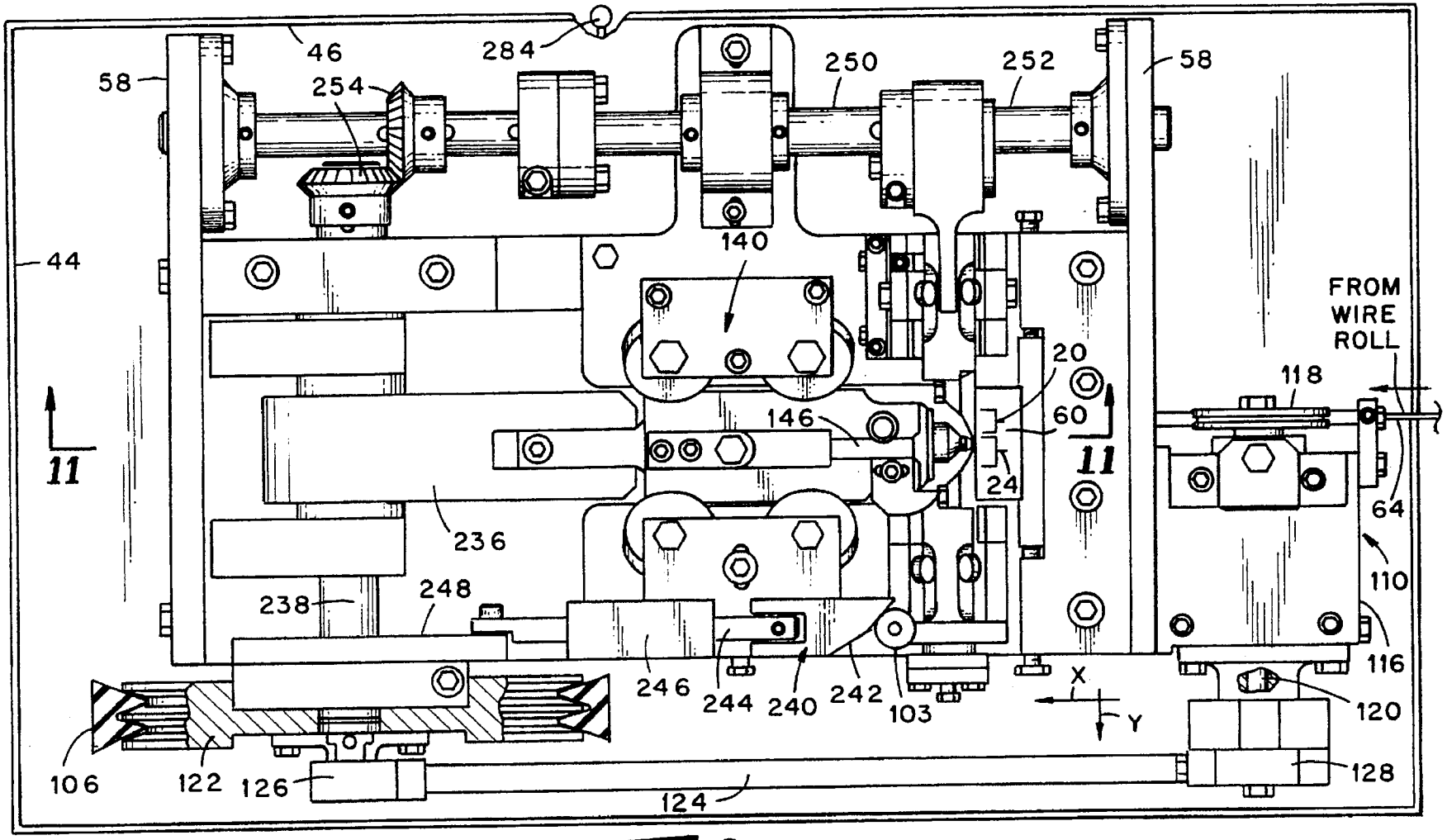
FIG. 2 is a plan view of the apparatus of the FIG. 1 system, shown with the lid removed.
Figure 3:
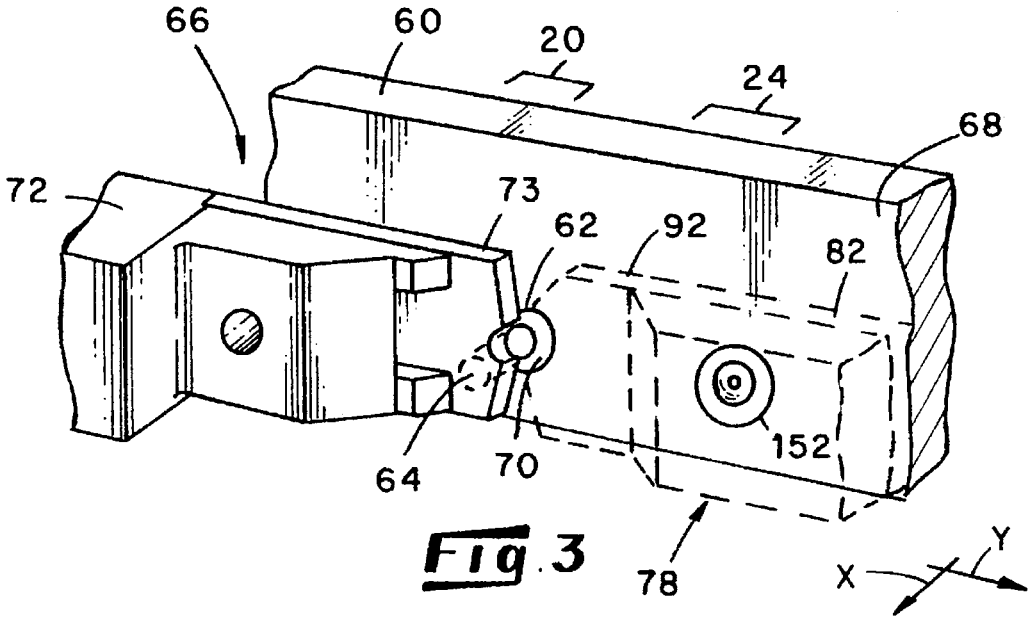
FIG. 3 is a perspective view of a fragment of the FIG. 2 apparatus illustrating the position of various components of the apparatus when positioned in condition for shearing a wire blank from a length of wire.
Figure 4:
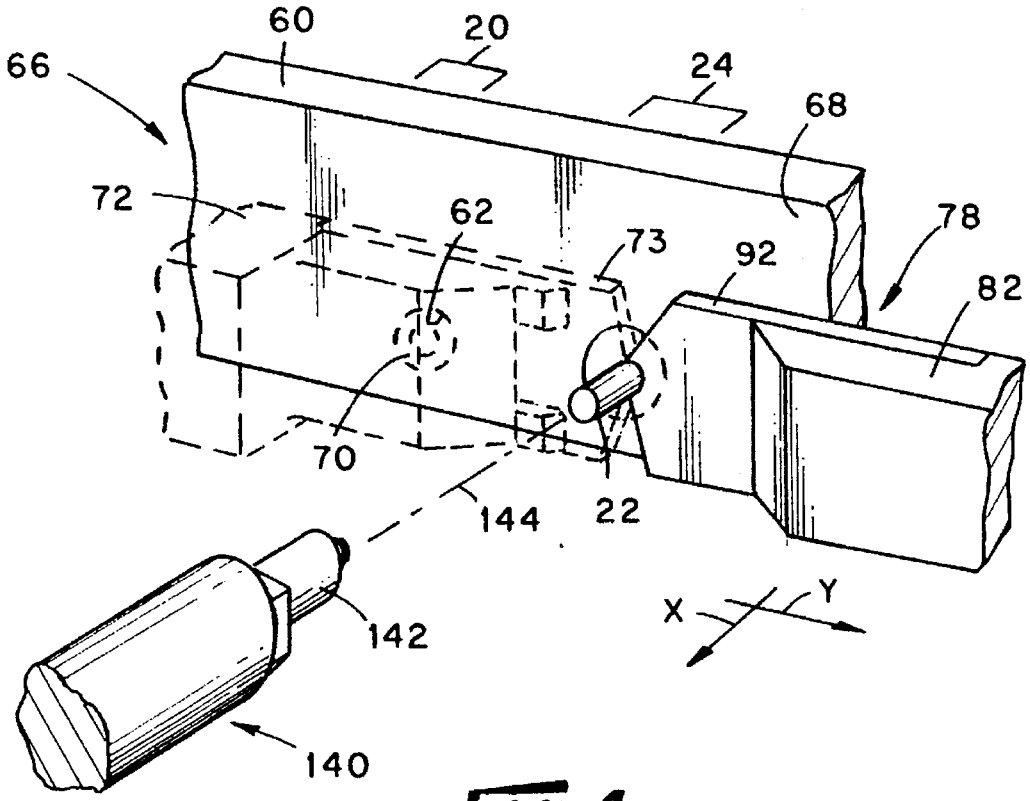
FIG. 4 is a view similar to that of FIG. 3 illustrating the position of various components of the apparatus when positioned in condition prior to a pressing of the sheared wire blank into a ball.
Figure 5A:
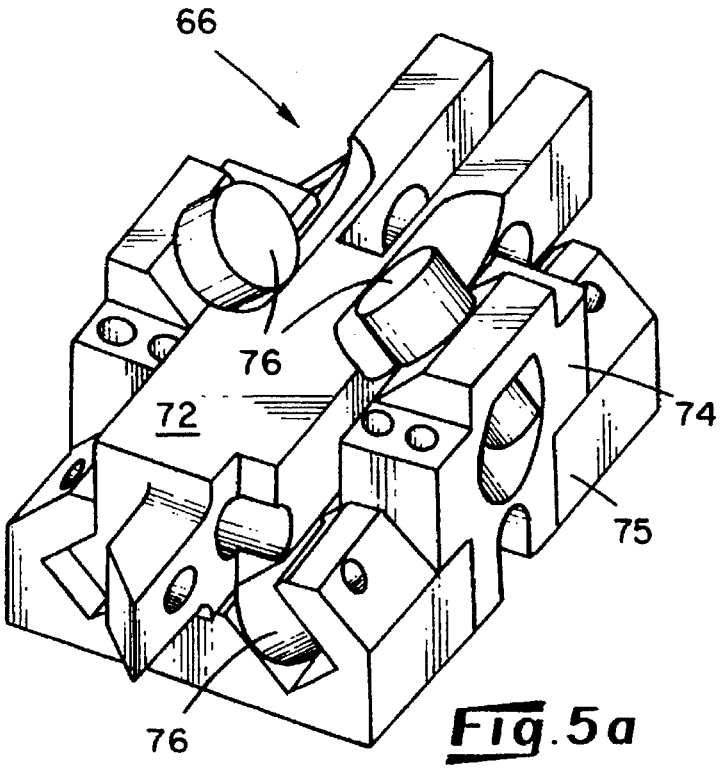
FIG. 5*a* is a perspective view of the shearing means of the FIG. 2 apparatus with which a wire blank is sheared from a length of wire.
Figure 5B:
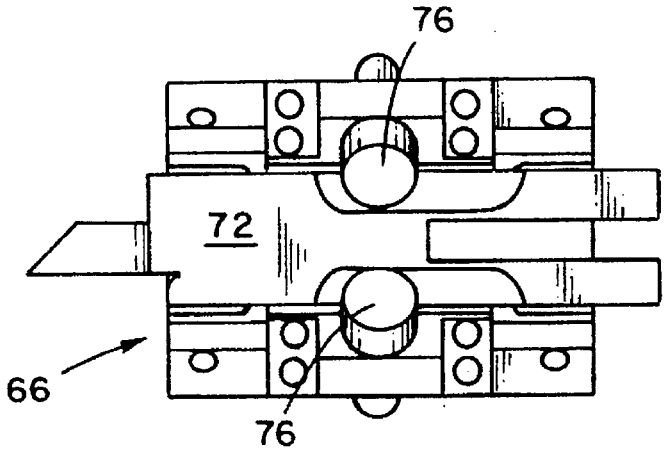
FIG. 5*b* is a plan view of the shearing means illustrated in FIG. 5*b*.
Figure 5C:
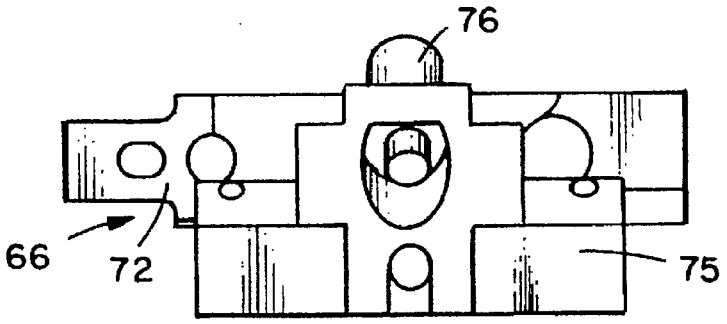
FIG. 5*c* is a side elevational view of the shearing means of FIG. 5*a* as seen from below in FIG. 5*b*.

During operation of the apparatus 32 and with reference to FIGS. 2–4, wire stock 64 is fed lengthwise along a direction parallel to the indicated X-coordinate axis to a first station, indicated 20, within the apparatus 32 at which a portion of the wire 64 is sheared from the remainder thereof to provide a blank 22. The blank 22 is then transported along a path parallel to the indicated Y-coordinate axis to a second station, indicated 24, within the apparatus 32 at which the blank 22 is pressed into a ball. The formed ball is subsequently ejected from the second station 24 and propelled downwardly through the apparatus 32 with the aid of a stream of air and collected by a ball-collection system 266 (FIG. 1) for use.

With reference again to FIG. 1, the apparatus 32 includes a box-like steel cabinet 44 having a compartment 46 and an upper lid 48 which is hingedly movable relative to the compartment 46 between a raised (opened) condition and a lowered (closed) condition. Mounted within the lower portion, indicated 50, of the compartment 46 is an electric motor 52 for moving selected components of the apparatus 32 between desired positions and a compressed air tank 56 and an associated check valve 54. Compressed air from a source, such as for example, from a main compressed air supply routed through the workshop facilities to the apparatus 32 is conducted to the air tank 56, and suitable hoses are connected between the air tank 56 and various components of the apparatus for providing a source of air, under pressure, to those components during apparatus operation. The check valve 54 is connected in-line between the main compressed air supply and the air tank 56 so that in the event of a pressure drop of the main compressed air supply below a threshold pressure level, e.g. about 90 psig, the compressed air stored within the tank 56 is prevented from exiting the tank 56 by way of the check valve 54. Thus, the check valve 54 helps to ensure that in the event of a shutdown or failure in operation of the main compressed air supply, a volume of suitably-compressed air is available for use by the apparatus components.

Beneath the lid 48 of the cabinet 44, and as best seen in FIG. 2, is mounted a frame 58 which spans the upper opening of the compartment 46, and it is this frame 58 that supports the mechanical components, described herein, which carry out the wire-shearing and ball-forming operations of the apparatus 32.

With reference again to FIGS. 2–4, the apparatus 32 includes a stationary plate 60 having a hole 62 through which a length of wire 64 is indexed incrementally and means, indicated 66, for shearing each incremental length of the wire as the wire is advanced so as to protrude through the plate hole 62. The plate 60 is mounted upon the frame 58 (FIG. 1) so that its face, indicated 68, is oriented substantially vertically. Thus, as wire 64 is urged incrementally through the hole 62 in the plate 60, the longitudinal axis of the wire 64 is arranged substantially horizontally. To reduce the likelihood that the plate 60 will experience wear as the wire 64 is slidably advanced through the hole 62, the hole 62 is lined with a quill, or bushing 70.

In the depicted apparatus 32 and as best shown in FIGS. 3, 4, and 5*a*–5*c*, the shearing means 66 includes a cutoff bar 72 which is movable relative to and along the face 68 of the plate 60. To this end, the apparatus 32 includes a guideway 74 having a base 75 which is mounted in a stationary condition upon the frame 58 and upper bearing carriers 77 secured atop the base 75 with bolts. A plurality of rollers 76 are rotatably mounted upon the guideway base 75 and carriers 77 for rollably supporting the body of the cutoff bar 72. The rollers 76 collectively provide a throughway within which the cutoff bar 72 is positioned so that movement of the cutoff bar 72 relative to the guideway body 75 is constrained by the rollers 76 to linear movement along a path parallel to the indicated Y-coordinate axis. The rollers 76 thus provide movable (low-friction) bearing surfaces which contact the surfaces of the cutoff bar 72 and accommodate high speed reciprocating movement of the cutoff bar 72 relative to the guideway base 75. In addition, by removing the upper bearing carriers 77 from the base 75, access can be had to the cutoff bar 72 for servicing purposes.

During operation of the apparatus 32, the cutoff bar 72 moves in a reciprocating (substantially horizontal) motion relative to the base 75 as the tip, indicated 73, of the bar 72 moves across the face 68 of the plate 60. In particular, when the cutoff bar 72 is moved forwardly (i.e. from its position at the first station 20 illustrated in FIG. 3) toward a forward limit of travel (corresponding to its position at the second station 24 illustrated in FIG. 4), the tip 73 moves across the face 68 of the plate 60 and shears off the portion of the wire stock 64 that protrudes through the bushing 70. By comparison, when the bar 72 is moved rearwardly (i.e. from the second station 24) to its rearward limit of travel (corresponding to its position at the first station 20), the tip 73 is returned to its initial ready position for a subsequent shearing operation.

The apparatus 32 also includes means, generally indicated 78 in FIGS. 3, 4 and 6, which cooperate with the cutoff bar 72 to hold the wire 64 both during the shearing operation and during the subsequent transport of the sheared wire blank into registry with means, described hereinafter, for pressing the blank 22 into a ball. In the depicted apparatus 32, the cooperating means 78 includes a carryover assembly 80 including a slide mechanism 82 which is mounted for back and forth movement across the face 68 of the plate 60. The carryover assembly 80 includes a guideway assembly 84 having a base 86 which is mounted in a stationary condition upon the frame 58 and upper bearing carriers 87 mounted atop the base 86. A plurality of rollers 88 are rotatably supported by the base 86 and carriers 87 and collectively provide a throughway within which the slide mechanism 82 is supported so that movement of the slide mechanism 82 relative to the base 84 is constrained by the rollers 88 to linear movement along a path parallel to the indicated Y-coordinate axis. The rollers 88 thus provide movable (low-friction) bearing surfaces which contact the surfaces of the slide mechanism 82 and accommodate high speed reciprocating movement of the slide mechanism 82 relative to the base 86. Furthermore and is the case with the shearing means 66, by removing the upper bearing carriers 87 from the base 86, access can be readily had to the slide mechanism 82.

Figure 8:
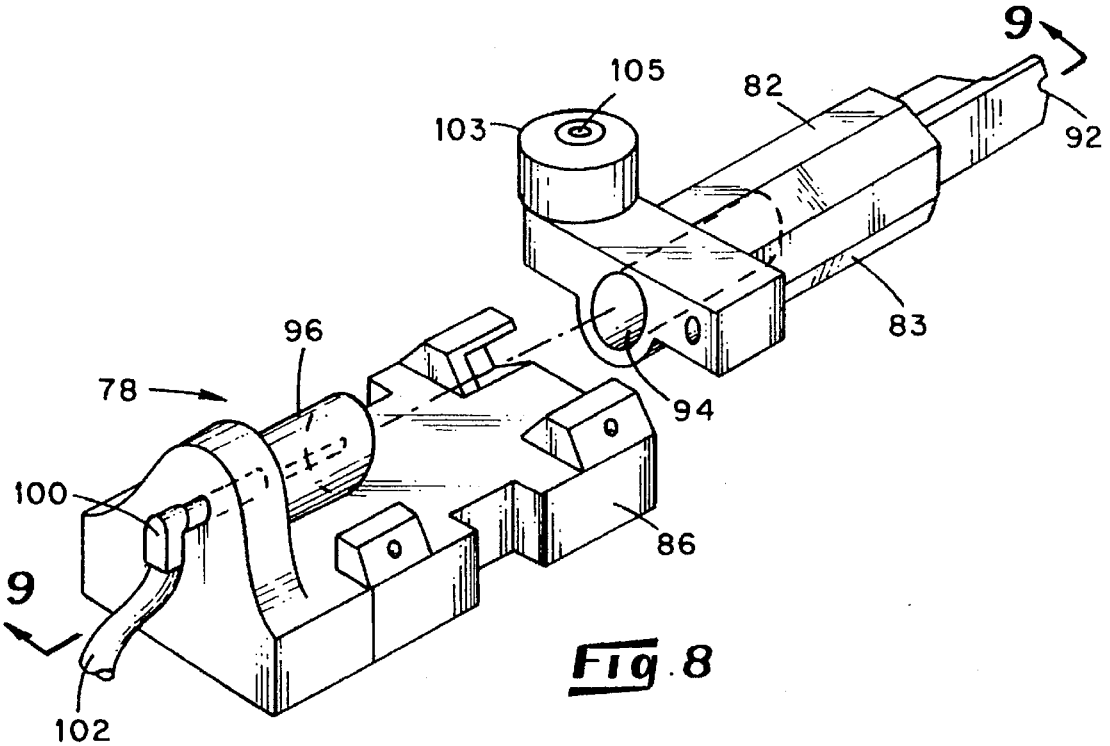
FIG. 8 is a perspective view of a portion of the carryover assembly of FIG. 6, shown exploded.
Figure 9:
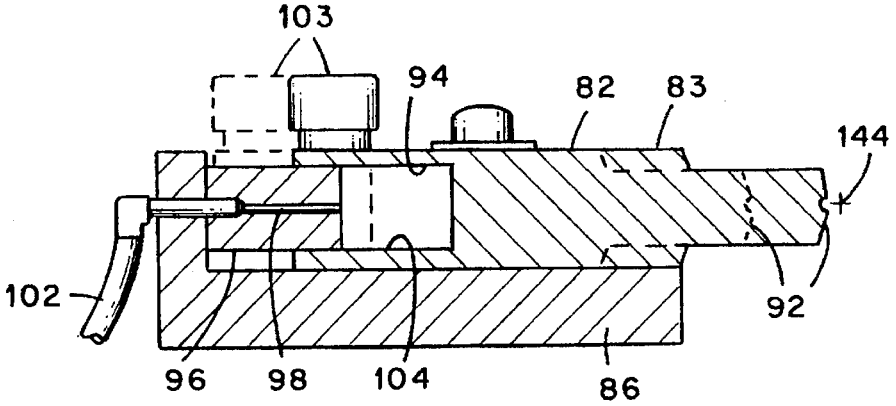
FIG. 9 is a cross-sectional view taken about along line 9—9 of FIG. 8.

With reference to FIGS. 8 and 9, the slide mechanism 82 includes a body 83 having a tip 92 and a bore 94 which is formed therein so as to extend generally axially along the body 83 and so as to open out of the body 83 at the end thereof opposite the tip 92. Slidably positioned within the bore 94 so as to extend along a portion thereof is a plunger 96 which is fixedly secured in a stationary condition with respect to the base 86. As best shown in FIG. 9, there is formed within so as to extend generally along the longitudinal axis of the plunger 96 is a through-opening 98, and an air fitting 100 is secured within the mouth of the through-opening 98 for receiving air, under pressure, from the compressed air tank 56 by way of an air hose 102. The (free) end surface of the plunger 96 and the interior of the bore 94 collectively provide a cavity 104 for containing pressurized air during the operation of the apparatus 32 and which accommodates movement of the slide mechanism body 83 relative to and along the length of the plunger 96 between, for example, its position indicated in solid lines in FIG. 9 and its position illustrated in phantom in FIG. 9. The carryover assembly 80 also includes a roller 103 which is journaled upon a post 105 secured to the body 83 of the slide mechanism 82 for rotation relative thereto about a substantially vertically-oriented axis and whose purpose will be apparent herein.

During operation of the apparatus 32 and with reference to FIGS. 3 and 4, the tip 92 of the slide mechanism 82 is moved from the first station 20 toward the second station 24 in conjunction with the tip 73 of the cutoff bar 72 as the cutoff bar 72 is forced from the first station 20 toward the second station 24. In other words, the force which moves the cutoff bar 72 from the first station 20 to the second station 24 effects a pushing of the slide mechanism 82 to the second station 24 through the tip 92 thereof. However, throughout the apparatus operation, the tip 92 of the slide mechanism 82 is continually biased toward the tip 73 of the cutoff bar 72 (i.e. toward the left as viewed in FIGS. 3 and 4) by the pressure of the air directed into the slide mechanism cavity 104 (FIG. 9) by way of the plunger through-opening 94 and air hose 102. It follows therefore that the biasing force of the pressurized air contained within the cavity 104 is overcome by the pushing force of the cutoff bar 72 applied to the slide mechanism 82 through the tip 92. It is a feature of the apparatus 32 that upon completion of the formation of a ball from a wire blank and following the return of the cutoff bar 72 to its initial (ready) position at the first station 20, the slide mechanism 82 is permitted to return to its ready position at the first station 20 under the influence of the air pressure within the cavity 104.

Figure 10:
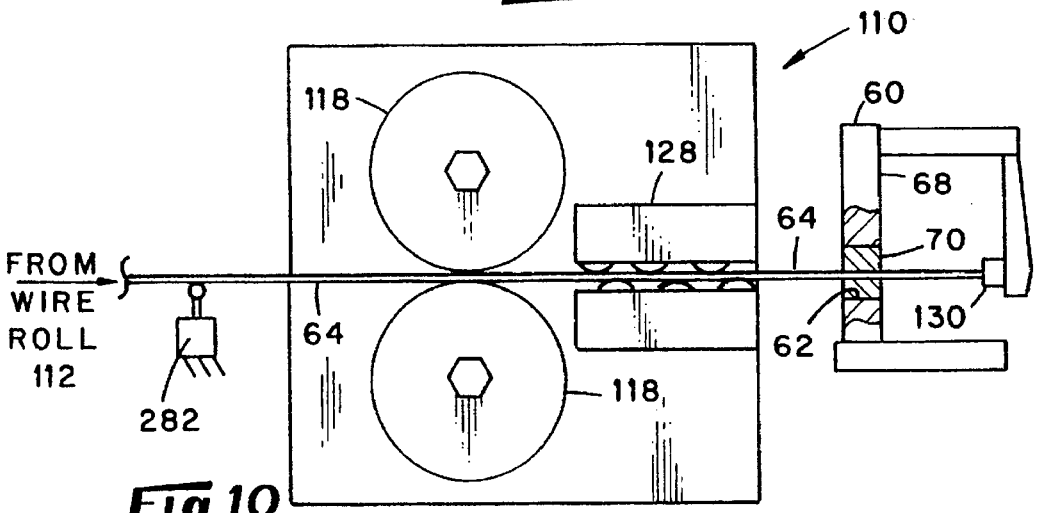
FIG. 10 is an elevational view of a portion of the FIG. 2 apparatus illustrating schematically various wire-feeding components of the apparatus as seen generally along line 10—10 of FIG. 2.

For advancing the wire stock 64 through the bushing 70 mounted within the plate 60, the apparatus 32 includes wire-feeding means, generally indicated 110 in FIG. 2, for pulling the wire 64 from a roll 112 (FIG. 1) of wire stock positioned, for example, upon a turntable 114 and indexing the wire 64 through the plate 60 in an incremental fashion. To this end, the wire-feeding means 110 includes a housing 116 fixedly mounted upon the frame 58 and a pair of cooperating feed rollers 118 (best shown in FIG. 10) which are journaled to the housing 116 for rotation relative thereto. The wire stock 64 extends between the peripheral surfaces of the feed rollers 118 so that as the feed rollers 118 are forced to rotate in the appropriate directions, the wire 64 is pulled from the roll 112 and advanced through the plate 60. The feed rollers 118 are coupled, by way of suitable feed clutch mechanisms mounted within the housing 116, to a shaft 120 (FIG. 2) extending through the opposite side of the housing 116. The shaft 120 is, in turn, coupled to a flywheel 122 byway of a rod 124 so that as the flywheel 122 is forced to rotate (by way of the electric motor 50), the shaft 120 is forced to rotate, as well. The flywheel 122 is joined to one end of the rod 124 by way of an eccentric 126, and the shaft 120 is joined to the other end of the rod 124 by way of an eccentric 128 so that as the flywheel 122 is rotated, the feed rollers 118 are rotated in somewhat of an intermittent fashion so that the wire 64 is advanced incrementally through the plate 60. It will be understood that during operation of the apparatus 32, a momentary pause is effected between successive instances of wire advancement, and it is during this momentary pause that a wire blank 22 is sheared from the remainder of the stock 64 by the cutoff bar 72 and transported to the second station 24, and the cutoff bar 72 returns from the second station 24 to its initial position adjacent the first station 20.

Also associated with the wire-feeding means 110 is a wire straightener 128 (FIG. 10) which ensures that the wire stock 64 which is advanced through the plate 60 is free of kinks, and an air-actuated cylinder is mounted within the housing 116 and associated with the feed clutch mechanisms of the wire-feeding means 110 for disengaging, when desired, the feed rollers 118 from the shaft 120. In addition, there is supported adjacent the plate 60 (and at a location downstream relative to the direction of wire advancement) a carbide post 130 having an end which is spaced from the face 66 of the plate 60 by a distance which corresponds generally with the length of the wire blank to be sheared from the stock 64. Thus, when the wire 64 is advanced through the plate 60 by the feed rollers 118, the end of the post 130 serves as an abutment stop which limits the distance that the wire 64 is permitted to protrude through the plate 60 and thereby ensures that each wire blank to be sheared from the stock 64 is of uniform length.

For pressing the wire blank 22 into the shape of a ball and with reference again to FIG. 2, the apparatus 32 includes pressing means 140 situated adjacent the second station 24. In the depicted apparatus 32, the pressing means 140 includes a punch assembly 142 (FIG. 4) which is mounted upon the frame 58 for linear (reciprocating) movement relative thereto along a path parallel to the indicated X-coordinate axis. More specifically and with reference to FIG. 11, the punch assembly 142 is mounted for movement along a work axis 144 toward and away from the face 68 of the plate 60. As the punch assembly 142 is moved (forwardly) toward the plate 60 and pressed against a blank 22 positioned in registry with the work axis 144, the blank 22 is pressed into a ball, and when the punch assembly 142 is moved (rearwardly) away from the plate 60, a fresh blank 22 can be transported into the spacing provided between the plate 60 and the punch assembly 142 in preparation of a subsequent ball-forming phase of the press operation.

The punch assembly 142 includes a main slide body 146 and a plunger 148 slidably mounted within the body 146 so as to protrude from an end thereof. A punch die 150 is, in turn, secured within the free end of the plunger 148 and is adapted to engage the wire blank 22 when the plunger 148 is moved a sufficient distance toward the plate 60. To aid in the formation of a blank 22 into a ball-like shape, there is mounted within the plate 60 a cooperating die 152 which is positioned in registry with the work axis 144 so that as the punch die 150 is urged toward the plate 60 and against the blank 22 during a ball-forming phase of the press operation, the blank 22 is pressed into the shape of a ball between the opposing surfaces of the punch die 150 and the cooperating die 152. In this connection, the opposing surfaces of the punch die 150 and the cooperating die 152 are each provided with a recess of generally hemispherical configuration.

Figure 11:
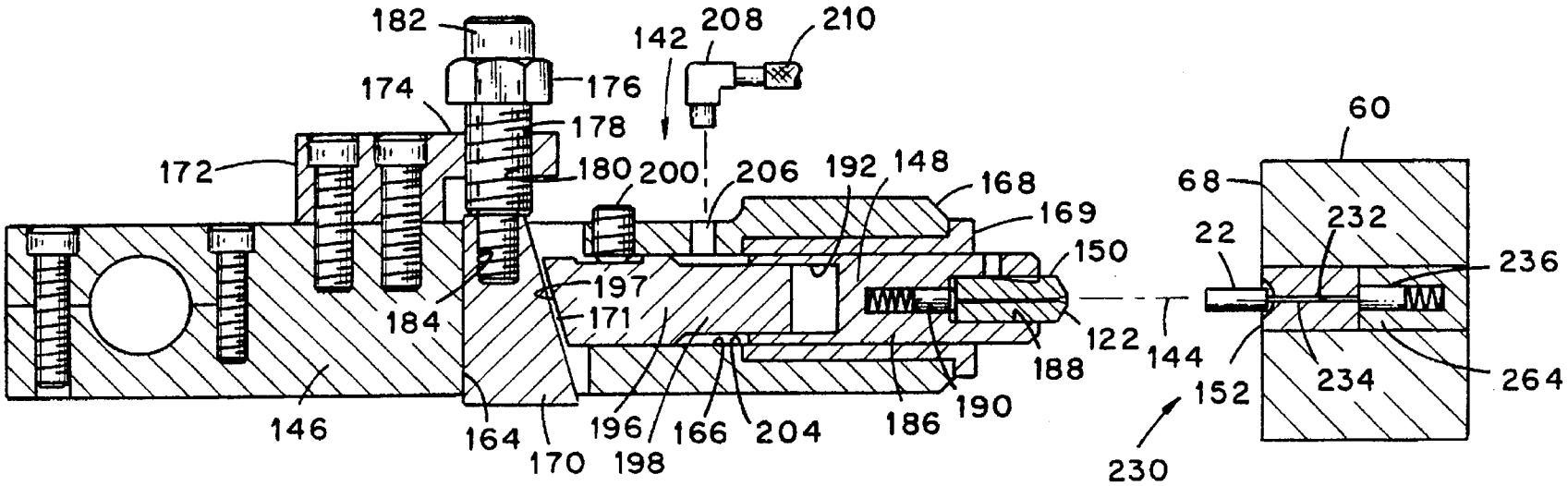
FIG. 11 is a cross-sectional view of the plunger assembly of the FIG. 1 apparatus as viewed along line 11—11.
Figure 11A:
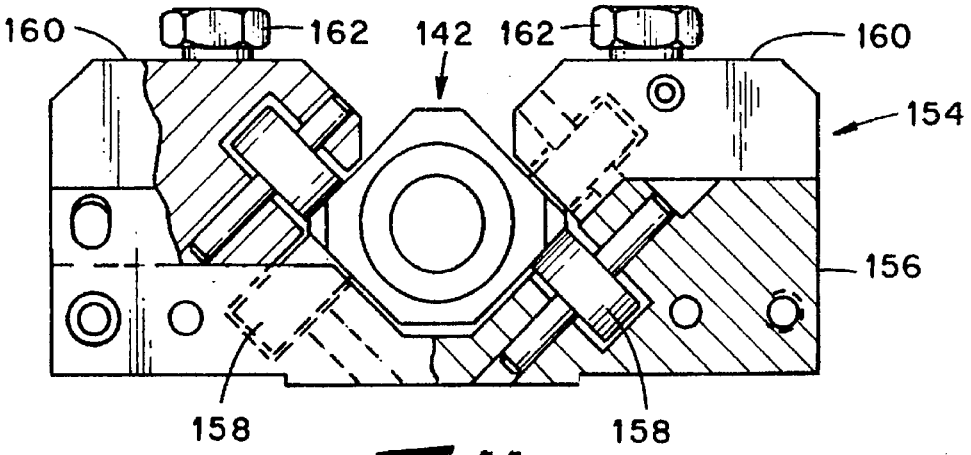
FIG. 11*a* is a transverse cross-sectional view of the plunger assembly illustrated in FIG. 11.

As best shown in FIG. 11*a*, the punch assembly 142 is movably supported upon the frame 58 by means of a guideway assembly 154 having a base 156 and upper bearing carriers 160 hingedly mounted upon the base 156. The base 156 is, in turn, fixedly secured upon the frame 58, and a plurality of rollers 158 are rollably mounted within the base 156 and upper bearing carriers 160. The rollers 158 collectively provide a throughway within which the punch assembly 142 is positioned so that the movement of the punch assembly 142 is confined to linear movement along the work axis 144 toward and away from the cooperating die 152. It will be understood that the rollers 158 which are mounted within the base 156 engage the lower surfaces of the punch assembly 142, while the rollers 158 which are mounted within the upper bearing carriers 160 engage the upper surfaces of the punch assembly 142. In addition, the upper bearing carriers 160 are hingedly connected along the edges thereof to the base 156 yet are secured in a stationary condition atop the base 156 with a pair of bolts 162 so that access can be readily had to the punch assembly 142 (e.g. for servicing purposes) by removing the two bolts 162 and pivoting the carriers 160 relative to the base 156 to an out-of-the-way condition.

With reference again to FIG. 11, the body 146 of the main slide of the punch assembly 142 includes a through-opening 164 extending substantially vertically therethrough and an opening 166 which is formed so as to extend axially along the body 146 from the through-opening 164 to the end, indicated 168, thereof. A section of the opening 166 disposed adjacent the forward end 168 is lined with a bushing 169. The plunger 148, introduced earlier, is slidably positioned with the bushing 169 so that its free end protrudes from the main slide body 146.

A wedge element 170 having a canted surface 171 is positioned within the vertical through-opening 164 to accommodate an adjustment in vertical position therealong, and an arrangement 172 including a bracket 174 and screw 176 is secured atop the body 146 of the main slide for cooperating with the wedge member 170 in a manner which moves the wedge member 170 through the through-opening 164 in either an upwardly or downwardly direction as the head of the screw 176 is rotated in one rotational direction or the other. To this end, the screw 176 has a shank which is threaded within an internally-threaded bore 178 of the bracket 174 and has an internal bore 180 which extends through the middle thereof for loosely accepting a headed pin 182. The headed pin 182 is secured within a threaded recess 184 provided in the upper surface of the wedge member 170, and the lower end of the screw 176 is positioned in engagement with the upper surface of the wedge member 170.

Thus, by rotating the head of the screw 176 relative to the bracket 174 in one rotational direction so that the screw 176 is urged downwardly, the wedge member 170 is forced downwardly through the through-opening 164 of the main slide body 146. Conversely, by rotating the head of the screw 176 relative to the bracket 174 in the opposite rotational direction so that the screw 176 is moved upwardly, the wedge member 170 is lifted upwardly along the through-opening 164 by way of the pin 182. As will be apparent herein, the wedge member 170 (with its canted surface 171) and the associated bracket and screw arrangement 172 accommodate an adjustment in the position of the plunger 148 relative to the main slide body 146 prior to a ball-forming cycle of a press operation.

With reference still to FIG. 11, the plunger 148 includes a body 186 having a forwardly-opening bore 188 which opens out of the free end (i.e. forward end) of the body 186, a circular recess 190 which is formed in the bottom of the bore 188, and a rearwardly-opening bore 192 which opens out of the body 186 opposite the free end thereof. In addition, the body 186 includes a notch 194 (best shown in FIG. 12) formed in one side of the body 186 for a reason which will be apparent herein.

The punch assembly 142 also includes an intermediate member 196 (having a canted surface 197) positioned along the length of the bore 192 so as to be disposed generally between the canted surface 171 of the wedge member 170 and the plunger body 186. The intermediate member 196 has a large end portion having a diameter which is slightly smaller than that of the opening 166 and a smaller end portion 198 which is sized so as to be loosely accepted by the rearwardly-opening bore 192 of the plunger body 186. During a ball-forming phase of a press operation during which the punch die 150 is urged into a blank 22 and toward the cooperating die 152, the plunger body 186 is acted upon by the main slide 146 through the wedge member 170 and the intermediate member 196. Thus, the position of the punch die 150 relative to the main slide body 146 can be preset by adjusting the vertical position of the wedge member 170 along the vertically-opening through-opening 164. Following such an adjustment in position of the wedge member 170, the intermediate member 196 is secured in place along the length of the bore 192 with a set screw 200.

Figure 12:
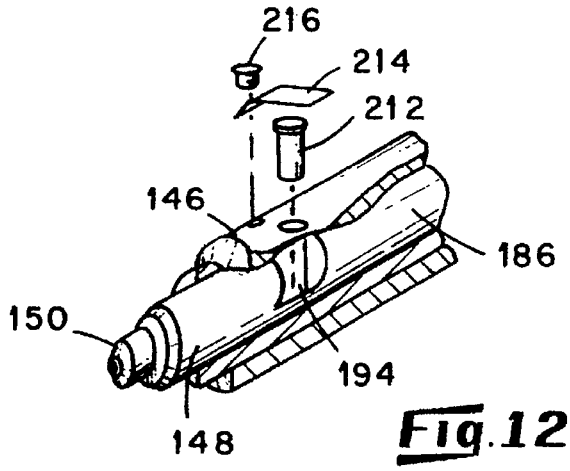
FIG. 12 is a perspective view of a fragment of the plunger assembly of the FIG. 1 apparatus.

The annular surface of the small end portion 198 of the plunger body 186 and the surface of the opening 166 provide opposing walls of a cavity 204 for receiving air, under pressure, from the air tank 56 (FIG. 1). In this connection, the main slide body 146 includes an opening 206 in one side thereof which provides communication with the cavity 204, and an air fitting 208 is secured in the opening 206 for accepting air, under pressure, from the air tank 56 by way of an air hose 210. During operation of the apparatus 32, the plunger 148 is continually biased along the work axis 144 relative to the main slide body 146 toward the cooperating die 152 by the pressurized air conducted to the cavity 204. However, the plunger 148 is prevented from coming out of the (forward) end of the main slide body 146 by means of a pin 212 (FIG. 12) which extends through one side of the main slide body 146 and is loosely arranged within the notch 194 provided in one side of the plunger body 186. Thus, the pin 212 serves to capture the plunger 148 between the opposite sides of the notch 194 while it permits the plunger 148 to be shifted along the work axis 144 relative to the body 146 of the main slide between forward and rearward limits of travel. As best shown in FIG. 12, the pin 212 is secured within the main slide body 146 with a plate 214 which, in turn, is secured to the main slide body 146 with a set screw 216. Thus, the plate 214 is held in position across the head of the pin 212 so that the pin 212 is prevented from coming out of the main slide body 146.

Figure 12A:
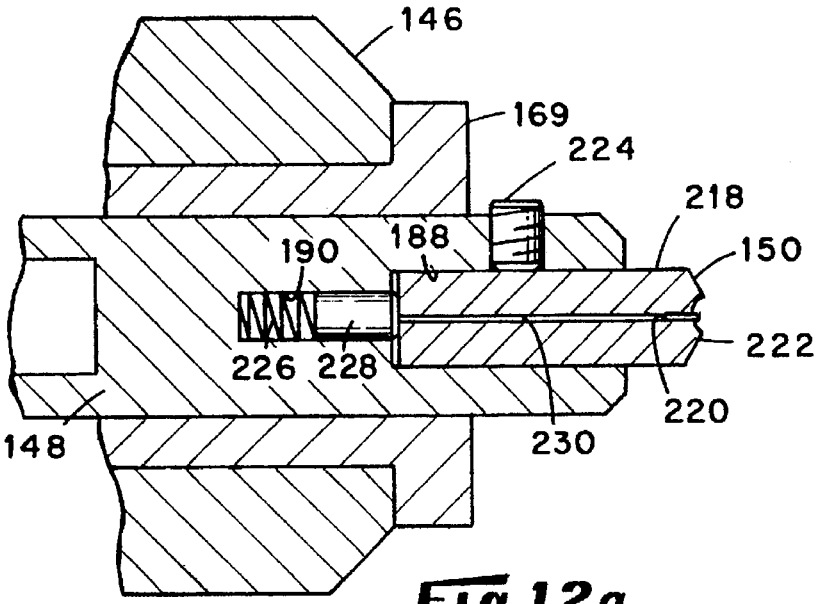
FIG. 12*a* is a cross sectional view similar to that of FIG. 11 but showing a portion of the FIG. 11 assembly drawn to a slightly larger scale.
Figure 14:
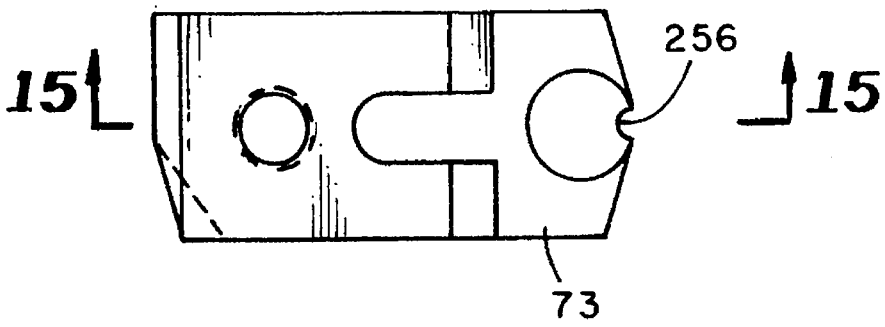
FIG. 14 is a view of the tip-providing element of the cutoff bar of the FIG. 1 apparatus.
Figure 15:
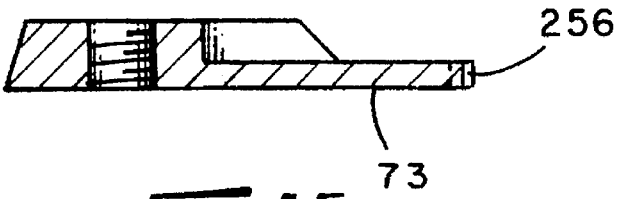
FIG. 15 is a cross-sectional view taken along line 15—15 of FIG. 14.
Figure 16:
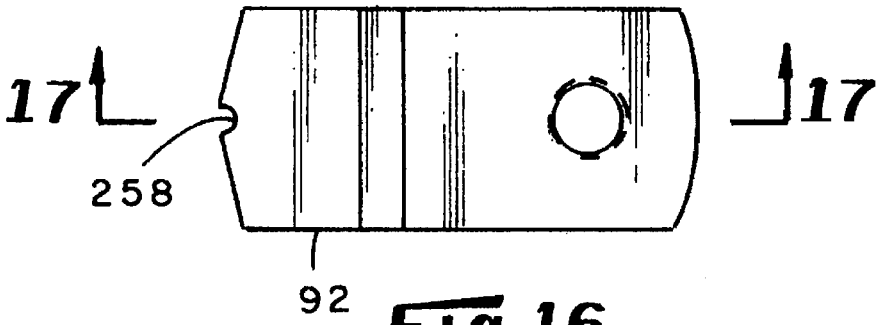
FIG. 16 is a view of the tip-providing element of the carryover assembly of the FIG. 1 apparatus.
Figure 17:
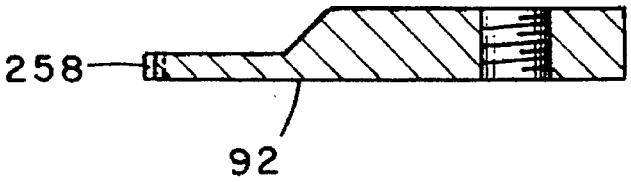
FIG. 17 is a cross-sectional view taken along line 17—17 of FIG. 16.

With reference to FIG. 12*a*, the punch die 150 includes a substantially cylindrical body 218 having a central bore 220 defined therein and a forward end 222 which provides the aforementioned recess of hemispherical configuration. The punch die 150 is positioned within the forwardly-opening bore 188 of the plunger body 186 and is secured therein with a set screw 224 which extends through one side of the plunger body 148. Disposed within the recess 190 is a compression spring 226 and a knockout pin holder 228 which act against the back of a knockout pin 230 extending through the central bore 220. Until a blank 22 is engaged by the punch die 150, the end of the knockout pin 230 protrudes through the bottom of the recess provided in the punch die 150. However, upon pressing of the punch die 150 against a blank 22 during a ball-forming phase of a press operation, the spring 226 permits the pin 230 to retract within the recess 190 so as not to adversely effect the resultant shape of the pressed blank. Upon subsequent withdrawal of the punch die 150 away from the cooperating die 152 following formation of a ball, the spring 226 urges the end of the pin 230 to its former (protruding) position and simultaneously ejects the formed ball from the forward end 222 of the punch die 150.

For purposes of ejecting the formed ball from the recess provided in the cooperating die 152 and with reference again to FIG. 11, there is associated with the cooperating die 152 a knockout pin arrangement 230 similar to that of the punch die 150. More specifically, the cooperating die 152 is provided with a central bore 232 and a spring-biased knockout pin 234 which extends through the bore 232 and is maintained therein by means of a spring and holder arrangement 236 mounted behind the die 150. Until a blank 22 is pressed by the punch die 150 into the hemispherically-shaped recess of the cooperating die 152, one end of the knockout pin 234 protrudes outwardly through the recess of the cooperating die 152. However, as the blank 22 is pressed against the cooperating die 152 during a ball-forming phase of a press operation, the pin 234 is permitted by the spring and holder arrangement 236 to retract so as not to adversely effect the resultant shape of the pressed blank. Upon subsequent withdrawal of the punch die 150 away from the cooperating die 152 following formation of a ball, the knockout pin 234 is urged by the spring and holder arrangement 236 to its former (protruding) position through the cooperating die 152 and simultaneously ejects the formed ball from the recess of the cooperating die.

As will be apparent herein and with reference again to FIG. 2, the main slide body 146 and plunger 148 are moved toward and away from the plate 60 and the cooperating die 152 by means of an eccentric 236 which is secured about a shaft 238 rotated by the flywheel 122. The flywheel 122 is, in turn, rotated by the electric motor 52 by way of a drive belt 106 connected between the motor 52 and flywheel 122.

With reference still to FIG. 2, there is disposed adjacent the main slide body 146 a cam member 240 having a cam surface 242 and which is mounted for sliding movement relative to the frame 58 along a path parallel to the X-axis. To this end, the cam member 240 is fixedly secured to one end of a shaft 244 which, in turn, is slidably supported within a bracket 246 attached to the frame 58. The other end of the shaft 244 is secured to an eccentric 248 rotatably mounted about the shaft 238. As will be apparent herein, the cam member 240 is moved linearly along a path parallel to the X-axis in conjunction with the movement of the main slide body 146 toward and away from the cooperating die 152 for moving the slide mechanism 82 of the carryover assembly 80 to an out-of-the-way position and permits the return of the carryover assembly 80 to a ready position at the first station 20.

More specifically, as the main slide body 146 moves toward the plate 60 during a press operation, the cam member 240 is moved (rightwardly as viewed in FIG. 2) into engagement with the roller 103 associated with the carryover assembly 80 so that the cam surface 242 forces the roller 103, and consequently the main slide body 146, to move (downwardly as viewed in FIG. 2) along the Y-axis from the second station 24 to an out-of-the-way position at which the punch die 150 can move into engagement with the cooperating die 152 without interference from the slide mechanism 82 of the carryover assembly 80. Upon movement of the main slide body 146 away from the plate 60 following completion of the ball-forming phase of a press operation, the cam member 240 moves (leftwardly as viewed in FIG. 2) away from the plate 60 so that the cam surface 242 permits the roller 103, and consequently the main slide body 146, to return (under the influence of the air pressure within its cavity 104) to its position adjacent the uncut wire stock 64 protruding through the plate 60. In addition, the shape of the cam surface 242 is configured to permit the slide mechanism 82 to return softly (rather than abruptly) to an initial position at the first station 20 and is advantageous in this respect.

Figure 13:
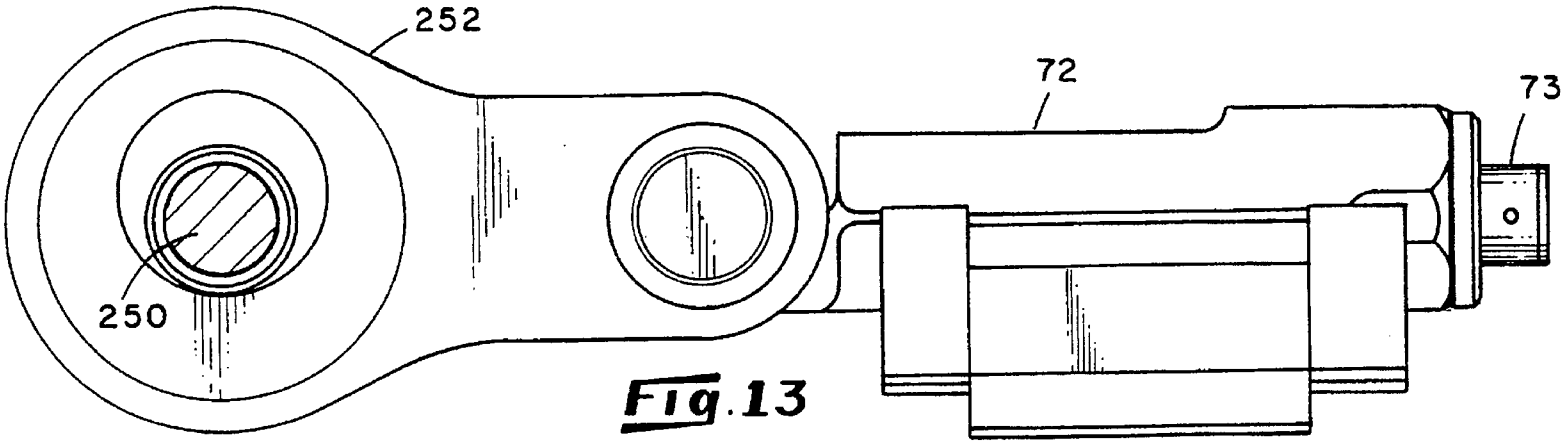
FIG. 13 is a cross-sectional view of a fragment of the FIG. 1 apparatus as viewed about along line 13—13 of FIG. 2.

It will be understood that the apparatus frame 58 rotatably supports shafts and eccentrics which provide the motive power behind the translational movement of various working components of the apparatus 32. One such shaft, i.e. the shaft 238, has been introduced above as supporting the flywheel 122 and eccentrics 236 and 248 for moving the slide mechanism 82 and the cam member 240 between forward and rearward limits of travel (relative to the plate 60) along paths parallel to the indicated X-coordinate axis. To this end, the shaft 238 is rotatably supported within appropriate bearings mounted within the frame 58 so that the shaft 238 is supported for rotation about an axis oriented parallel to the indicated Y-coordinate axis. There is also supported within the frame 58 a second shaft 250 which is arranged for rotation about an axis oriented substantially parallel to the indicated X-coordinate axis and which is coupled to the shaft 238 with meshed gears 254 so that rotation of the shaft 238 effects the rotation of the other shaft 250. As best shown in FIG. 13, an eccentric 252 is rotatably mounted about the shaft 250 and operatively coupled to the end of the cutoff bar 72 opposite the tip 73 for moving the bar 72 along a path parallel to the Y-coordinate axis between its fore and aft limits of travel (i.e. between the first and second stations 20 and 24). As will be apparent herein, the eccentrics 252, 236 and 238 are coordinated with one another so that as the shafts 238 and 250 are rotated by means of the flywheel 122, the cutoff bar 72, slide mechanism 82 and punch assembly 142 are in desired positions relative to one another throughout the press operation.

The operation of the apparatus can be summarized as follows. At the outset of a single cycle of a press operation and as best shown in FIG. 3, the cutoff bar 72 and the slide mechanism 82 of the carryover assembly 80 are positioned in ready positions at the first station 20, and an uncut segment of the wire stock 64 protrudes through the plate 60 and between the tips 73 and 92 of the bar 72 and slide mechanism 82. Meanwhile, the main slide body 146 of the punch assembly 142 is spaced far enough away from the plate 60 (along the X-axis) to accommodate the positioning of the slide mechanism 82 of the carryover assembly 80 between the main slide body 146 and the plate 160. The cutoff bar 72 is then forced rightwardly, as viewed in FIG. 3, by means of the rotating shaft 250 and eccentric 252 in a manner which shears the blank 22 from the remainder of the wire stock 64 and pushes the slide mechanism 82 of the carryover assembly 80 from the first station 20 toward the second station 24 in a single stroke. It will be understood that upon shearing the blank 22 from the remainder of the wire stock 64, the blank 22 remains held, by a pinching action, between the tips 73 and 92 of the cutoff bar 72 and slide mechanism 82 so that its longitudinal axis remains oriented parallel to the X-axis. In addition, the blank 22 continues to be held between the tips 73 and 92 for a period of time following movement of the blank 22 into registry with the work axis 144. Such an orientation of the blank 22 ensures that the subsequent pressing of the blank 22 into a ball provides the ball with a desirable density and grain orientation. Accordingly and with reference to FIGS. 14–17, the tips 73 and 92 have blank-engaging edges 256 and 258 which are shaped in the manner shown in FIGS. 14–17 so that upon severance of the blank 22 from the wire stock 64 and subsequent transport of the blank 22 to the second station 24, the blank 22 retains its aforedescribed orientation parallel to the X-axis.

Figure 18:
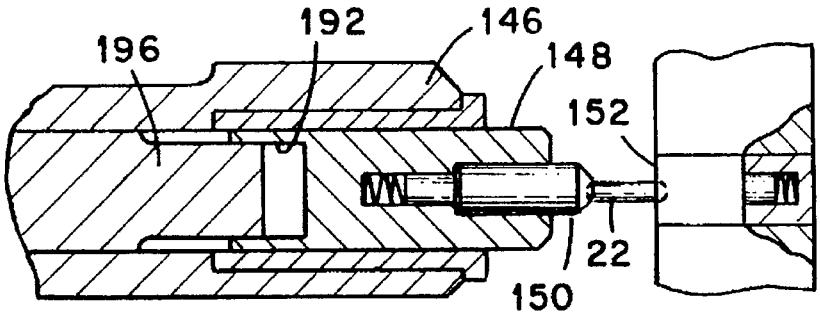
FIGS. 18–21 are views illustrating schematically the relative positions of components of the punch assembly of the FIG. 1 apparatus during a cycle of the apparatus operation.
Figure 19:
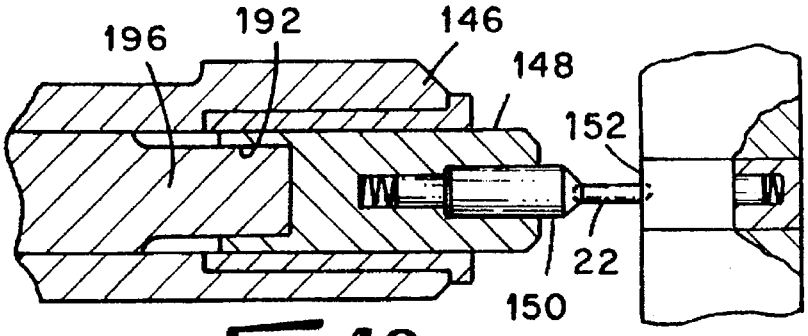
Figure 20:
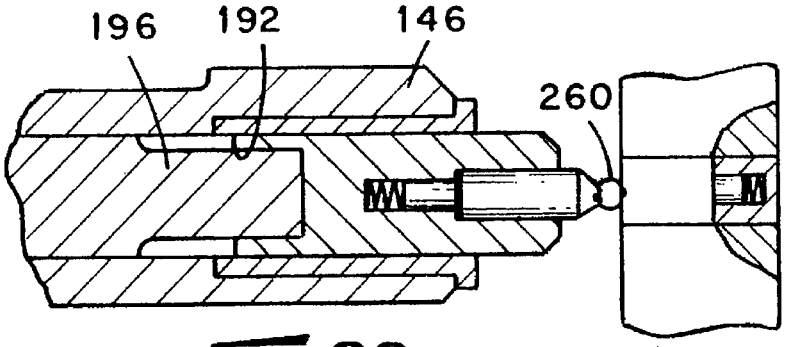

The cutoff bar 72 and the slide mechanism 82 continue to advance toward the second station 24 and slow to a halt at the positions depicted in FIG. 4 at which the tips 73 and 92 are disposed on opposite sides of the work axis 144 and so that the blank 22 held therebetween is positioned in registry with the work axis 144. Meanwhile, the main slide body 146, with the plunger assembly 148 being biased to its extended position relative to the main slide body 146 (as shown in FIG. 11), begins to move along the work axis 144 toward the cooperating die 152 and the blank 22 which is moved into registry with the work axis 144. While the cutoff bar 72 and slide mechanism 82 dwell momentarily at the second station 24 (by way of the eccentric 252), the punch die 150 is moved into contact with the blank 22 as shown in FIG. 18. The blank 22 is thereby held in registry with the work axis 144 between the punch die 150 and the cooperating die 152 and between the tips 73 and 92, and the advancement of the punch die 150 is halted by the reactive forces exerted thereagainst by the blank 22 which overcome the biasing force exerted by which the pressurized air of the cavity 192 upon the plunger 148. The main slide body 146, however, continues its advancement toward the cooperating die 152 as the plunger 148 remains in a stationary condition against the blank 22 so that the intermediate member 196 eventually strikes the bottom of the bore 192 (as shown in FIG. 19) and so that the forces exerted by the main slide body 146 toward the cooperating die 152 subsequently force the plunger 148 and punch die 150 forwardly to press the blank 22 into a ball 260 (as shown in FIG. 20). In the depicted apparatus 32, the main slide body 146 has a total stroke length of about 9/16 inch, and of that 9/16 inch figure, the plunger assembly 148 experiences a dwell (i.e. the aforedescribed momentary halt in advancement) as the body 146 moves about 5/32 of an inch along the work axis 144.

It is a feature of the apparatus 32 that the cutoff bar 72 and slide mechanism 82 begin to move away from the work axis 144 in opposite directions therefrom during the period at which the advancement of the plunger 148 and punch die 150 toward the cooperating die 152 is halted by the blank 22. To this end, the cutoff bar 72 is withdrawn from the second station 24 toward the first station 20 by way of the eccentric 252 (FIG. 13) and rotating shaft 250. On the other hand, the slide mechanism 82 is forcibly moved away from the work axis 144 in the direction opposite the first station 20 as the cam member 240 (whose movement is coordinated with that of the main slide body 146) is moved into contact with the roller 103 associated with the slide mechanism 82. As the cam member 240 is thus urged toward the plate 60 in conjunction with the main slide body 146, the roller 103 rolls along the cam surface 242 as the roller 103 is bodily moved (downwardly as viewed in FIG. 2) away from the work axis 144. Of course, as the roller 103 is bodily moved away from the work axis 144 by the cam member 240 in such a manner, the slide mechanism 82 of the carryover assembly 80 is forcibly moved away from the work axis 144 against the biasing force exerted by the pressurized air routed to the cavity 104 (FIG. 9) from, for example, a first position of the slide mechanism 82 depicted in solid lines in FIG. 9 to a second position depicted in phantom in FIG. 9. It follows that as the cutoff bar 72 and slide mechanism 82 are moved away from the work axis 144 as aforedescribed to the corresponding (out-of-the-way) positions, the plunger 148 and the punch die 152 (under the influence of the main slide body 146) can advance to the cooperating die 156 to press the blank 22 into a ball 260 (FIG. 20) without interference from the bar 72 or slide mechanism 82.

Upon completion of the ball-forming phase of the press operation, the main slide body 146 begins to withdraw from the cooperating die 152 by way of the eccentric 236 and rotating shaft 238. As the main slide body 146 is withdrawn as aforedescribed from the cooperating die 152, the biasing force of the pressurized air contained within the cavity 192 retains the punch die 150 in a stationary position against the formed ball 260 until the relative movement between the plunger 148 and the main slide body 146 is halted by the pin 212 (FIG. 12). At that moment, the main slide body 146 pulls the plunger 148 (and punch die 150) away from the formed ball 260 and thereby permits the ball 260 to be ejected from the recess of the dies 150 and 152 by the corresponding knockout pins.

As the main slide body 146 is withdrawn from the corresponding die 152, the cam member 240 is also withdrawn from the plate 60 along a path parallel to the Y-axis. Of course, as the cam member 240 is withdrawn from the plate 60, the slide mechanism 82 of the carryover 80 is permitted to return (under the influence of the pressure of the air routed to the cavity 104) toward the first station 20 as the roller 103 rolls along the cam surface 242. As mentioned earlier, the cam surface 242 is shaped so that the slide mechanism 82 returns softly (relatively slowly), rather than abruptly, toward its earlier, ready position adjacent at the first station 20. Furthermore, it will be understood that the cam surface 242 is shaped so that it does not move out of contact with the roller 103 until the slide mechanism 82 is returned to its ready position at the first station 20 at which the tip 92 of the slide mechanism 82 abuts the tip 73 of the cutoff bar 72. Thus, the cam member 240 and roller 103 act as cam and cam follower, respectively, to guide the movement of the slide mechanism 82 along the face 66 of the plate 60 from the moment that the slide mechanism 82 is moved away from the work axis 144 (prior to formation of the blank 22 into a ball 260) until the moment that the tip 92 of the slide mechanism 82 is returned to the first station 20. In the depicted apparatus 32, the total stroke length of the slide mechanism 82 (as measured between its out-of-the-way position and the first station 20) is about 1⅛ inch.

Between the moment that the cutoff bar 72 is returned to its ready position adjacent the first station 20 and the moment that the tip 92 of the slide mechanism 82 is returned to its ready position adjacent the first station 20, the wire stock 64 is indexed by the wire-feeding means 110 (FIG. 10) so that another incremental length of wire stock 64 protrudes through the plate 60 to a position as shown in FIG. 3 at which the incremental length of wire 64 can be subsequently sheared from the remainder of the stock 64 as a fresh blank 22. Upon the return of the tip 92 to its position at the first station 20 so that the wire stock 64 is held between the tips 92 and 73, the main slide body 146 reaches its rearwardmost, i.e. farthest, position of travel away from the plate 60 and a subsequent cycle of the press operation is ready to commence.

Figure 21:
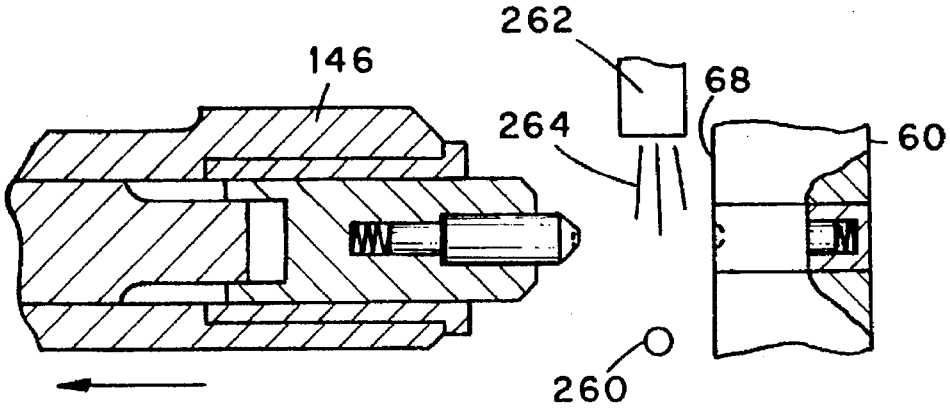

Following formation of a ball 260 from a blank 22 and with reference to FIG. 21, the ball 260 is ejected from the recesses of the dies 150 and 152 and directed downwardly through the apparatus 32. To speed the downward movement of the ball 260 and thereby accommodate higher rates of ball production, the apparatus 32 includes an air jet nozzle 262 mounted above the plate 60 for directing a stream 264 of air from the air tank 56 downwardly across the face 68 of the plate 60 at the second station 24. Any ball 260 formed at the second station 24 will therefore be immediately exposed to this continuous stream 264 upon its ejection from the dies 150 and 152 so that the ball 260 is pushed downwardly at a higher rate of speed than would be the case if only gravity was relied upon to move the balls 260 downwardly.

It will be understood that the movements of the aforedescribed components of the apparatus 32 are accurately controlled so that each component is moved to a desired position during an appropriate phase of a ball-forming cycle. To this end, adjustments can be made by way of the eccentrics 252, 248 and 236 and corresponding adjustment mechanisms (e.g. the aforedescribed wedge member 170 of the punch assembly 142 depicted in FIG. 11) to alter the position of the component along its corresponding axis of movement.

As mentioned earlier, the control of the operation of the system 30 is had at the control center 34 (FIG. 1) which houses a control computer responsible for various operations of the apparatus 32. Furthermore, for each of the electric motor 52 and compressor 54, there is mounted an ON/OFF switch upon the control panel 38. Moreover, various safety conditions and operating conditions of the apparatus 32 are monitored at the control center 34. If, for example, certain safety conditions are not satisfied (such as the lid 48 being completely closed and latched), the control computer will prevent the apparatus 32 from operating. Still further, a sensor 282 (FIG. 10) is supported adjacent the wire-feeding means 110 for sensing the presence of wire 64 routed therethrough and for delivering an appropriate signal to the control computer. If no wire 64 is sensed at the sensor 282 (indicating, for example, that the apparatus 32 has run out of wire), the apparatus 32 is shut down.

Furthermore, for purposes of monitoring the pressure applied to each blank 22 during a ball-forming phase of a ball-forming cycle, a pressure sensor 264 (FIG. 11) is mounted behind the cooperating die 152 and for delivering a signal to the control computer at the center 34 which, in turn, provides a visual display of the applied pressure, in the form of a numerical value, to an operator by way of the display panel 42. Thus, if the displayed values are either too high or too low to provide an acceptable ball, the machine can be shut down (manually or automatically) so that appropriate adjustments can be made.

Other features of the apparatus 32 involve the use of a mechanical chiller 284 (shown mounted upon one side of the cabinet 44 in FIG. 2) from which cool air is directed toward preselected bearings of the apparatus 32. In the depicted apparatus 32, cool air is directed from the chiller in streams onto the bearings associated with the eccentric 236 of the punch assembly 142 and the eccentric 252 of the cutoff bar 72. In addition, there is associated with the air lines leading from the air tank 56 an in-line oiler, indicated 286 in FIG. 1, which introduces lubricating oil into the stream of compressed air routed to the cavities 104 and 204 of the carryover assembly 80 and punch assembly 142, respectively. The air is permitted to escape (at a controlled rate) from the cavities 104 and 204 along the walls of the bore 94 of the slide mechanism 82 and the bushing 169 of the main slide assembly 146 so that these walls are suitably lubricated by the oil. A controlled rate of escape of the air from the cavities 104 and 204 is effected by small longitudinally-extending grooves provided along these walls. It follows that the slide mechanism 82 and the plunger 148 are lubricated along regions remote of the corresponding tip 92 and punch die 150 so that the blank 22 (as well as the resultant ball) are isolated from lubricating oil which may otherwise contaminate the surface of the formed ball.

Figure 22:
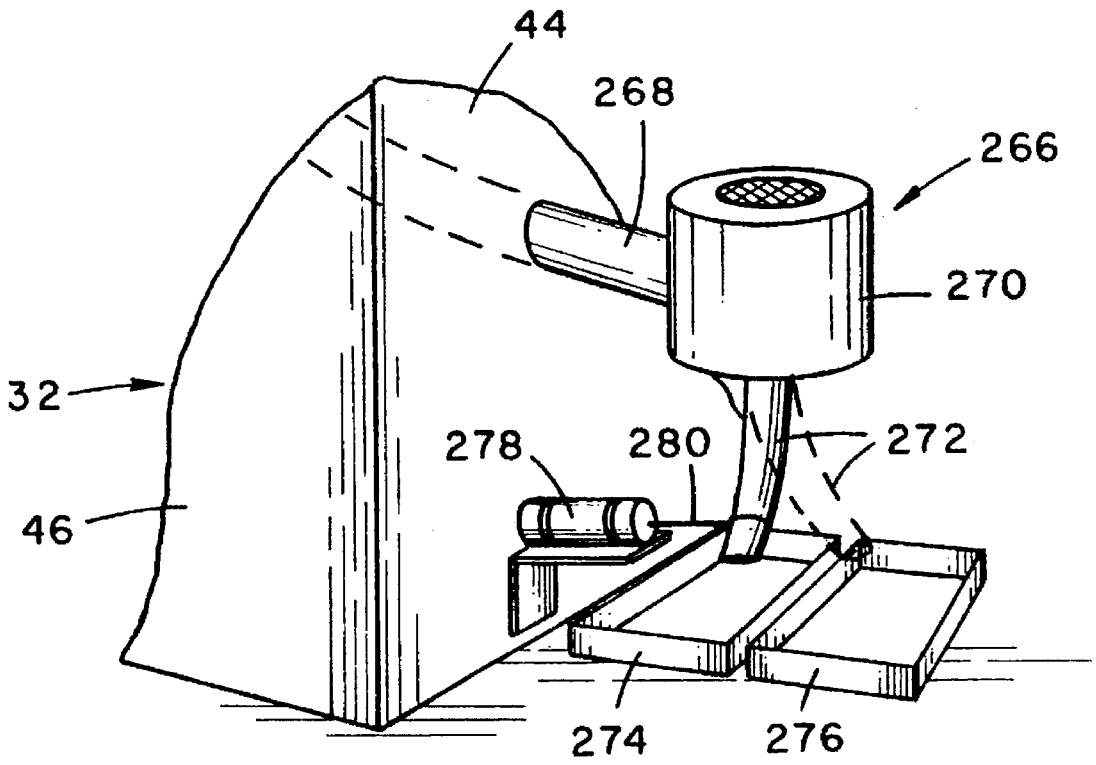
FIG. 22 is a view illustrating schematically the collecting of the formed balls during operation of the FIG. 1 apparatus.

With reference to FIG. 22, there is shown a ball-collection system 266 for collecting balls after they are formed. The depicted system 266 includes a conduit 268 which leads from the interior of the apparatus 32 and terminates at a head receptacle 270 joined to the end thereof. A flexible tube 272 depends downwardly from the head receptacle 270, and two containers 274 and 276 are disposed beneath the lower end of the tube 272. A solenoid-operated cylinder 278 is mounted upon the apparatus compartment 46 and has a ram 280 which is joined to the flexible tube 272 for selectively positioning the lower end of the tube 272 over one compartment 274 or the other compartment 276. Therefore, following formation of the balls 260, the balls 260 are directed downwardly through the apparatus 32 and are discharged therefrom by way of the conduit 268 and receptacle head 270 into one of the containers 274 or 276 by way of the tube 272.

In the depicted system 30, the operation of the cylinder 278 is controlled by the control computer housed at the control center 34, and the control computer is preprogrammed to direct balls into container 274 if the operating conditions of the ball-forming operations become unacceptable (e.g. the pressure applied to the blanks during the ball-forming operations are either too high or too low) and for a preselected period following start-up of the apparatus 32 (e.g. to ensure that operating conditions are at desired levels) and to direct balls into the container 276 at other times. Thus, all of the balls collected into container 276 are acceptable balls, while the balls collected in container 274 may be less than acceptable. The balls collected in the container 276 may subsequently be finished in a flashing operation for the purpose of removing the equators and poles from the formed balls to render the balls suitable for end use, for example, as ball bearings.

The aforedescribed system 30 has been found to be well-suited for forming balls 260 having a diameter of about ⅜ inch or less. For example, the apparatus 32 is capable of forming balls of 3/32 inch diameter out of wire stock comprised of 5210 chrome alloy steel having a diameter of about ⅛ inch. In addition, rates of production of the apparatus 32 which approach 1100 balls per minute have been achieved.

It will be understood that numerous modifications and substitutions can be had to the aforedescribed embodiment without departing from the spirit of the invention. Accordingly, the aforedescribed embodiment is intended for purposes of illustration and not as limitation.

We claim:

1. An apparatus for forming a ball of relatively small diameter from metal wire comprising:

means situated at a first station for holding a length of metal wire in a condition to be sheared from the remainder thereof;

means for shearing the length of metal wire from the remainder thereof to provide a blank from which a ball is subsequently formed and for transporting the blank to a second station including a cutoff bar having a wire-engaging tip positioned on one side of the length of wire held at the first station, a slide mechanism having a wire-engaging tip positioned on the opposite side of the length of wire held at the first station;

pressurized fluid means for biasing said slide mechanism toward the first station where said slide mechanism cooperatively associates with said cutoff bar to grasp said length of wire;

means for moving the cutoff bar and slide mechanism in unison from the first station to the second station, and adapted to displace the cutoff bar from the second station and to return the cutoff bar to the first station following transport of the blank to the second station;

pressing means supported adjacent the second station for pressing the blank into a ball including a die mounted in a stationary condition at the second station and a punch assembly which cooperates with the die for forming the blank into a ball as the blank is pressed between the punch assembly and the die, the punch assembly including a slide body mounted for movement between advanced and withdrawn positions toward and away from the die along a work axis, a plunger assembly for engaging the blank during the formation of the blank into a ball, the plunger assembly being supported by the slide body for movement relative thereto along the work axis between one condition at which the plunger assembly is in an extended position relative to the slide body and another condition at which the plunger assembly is in a retracted position relative to the slide body, and cam means associated and moveable with said slide body; and means for moving the slide body along the work axis toward and away from the die between its withdrawn position which accommodates the transport of the blank into registry with the work axis between the punch assembly and the die and its advanced position at which the plunger assembly is disposed adjacent the die;

cam follower means mounted on said slide mechanism; said cam means associated and moveable with said slide body projecting from said slide body in position to engage said cam follower associated with said slide mechanism whereby movement of said slide body from its withdrawn position toward its advanced position serves to cause said cam means to engage said cam follower and move said slide mechanism in a direction away from the second station to an out-of-the-way position relative to said punch assembly, and movement of said slide body from its advanced position toward its withdrawn position serves to disengage said cam means from said cam follower to free said slide mechanism to return to the first station under the influence of said pressurized fluid means for biasing said slide mechanism toward the first station.

2. The apparatus as defined in claim 1 further comprising a pressurized fluid source and a base upon which the slide mechanism is slidably mounted for movement along a linear path corresponding with the direction of movement of the slide mechanism between the first and second stations, and the slide mechanism and base include internal surfaces which collectively provide a cavity for receiving pressurized fluid from said pressurized fluid source so that the slide mechanism is biased from its out-of-the-way position toward the first station by pressurized fluid delivered to the cavity from the pressurized fluid source.

3. An apparatus as defined in claim 1 including a pressurized fluid source, and wherein the plunger assembly and slide body include internal surfaces which collectively provide a cavity for receiving pressurized fluid from said pressurized fluid source so that the plunger assembly is biased from the retracted position toward the extended position by pressurized fluid delivered to the cavity from the pressurized fluid source.

4. The apparatus as defined in claim 1 further comprising bearings mounted in a stationary condition relative to the work axis wherein the bearings include a plurality of rotatable rollers which provide a throughway within which at least one of the cutoff bar, slide mechanism and slide body is mounted so that movement of the one of the cutoff bar, slide mechanism and slide body is confined by the rollers to movement along a linear path.

5. A method for forming a ball of relatively small diameter from metal wire comprising the steps of:

holding a length of metal wire at a first station in a condition to be sheared from the remainder thereof;

shearing the length of wire from the remainder thereof to provide a blank with which a ball is subsequently formed;

providing means for transporting the blank to a second station including a cutoff bar and a slide mechanism;

transporting the blank to the second station by way of the blank-transporting means;

providing pressing means for pressing the blank into a ball wherein the pressing means includes a die fixedly mounted at the second station and a punch assembly which cooperates with the die to form the blank into a ball as the blank is pressed between the punch assembly and the die, the punch assembly including a slide body mounted for movement toward and away from the die along a work axis and a plunger assembly for engaging the blank during the formation of the blank into a ball wherein the plunger assembly is movably supported by the slide body for movement relative thereto along the work axis between one condition at which the plunger assembly is an extended position relative to the slide body and another condition at which the plunger assembly is in a retracted position with respect to the slide body and wherein the plunger assembly is biased from its retracted position toward its extended position;

moving the slide body along the work axis toward the die while the plunger assembly is arranged in its extended condition relative to the slide body so that the plunger assembly contacts the blank which, in turn, halts the advancement of the plunger assembly until the continued movement of the slide body toward the die moves the plunger assembly into the aforesaid retracted position and the blank is subsequently pressed by the punch assembly to form the blank into a ball;

providing cam follower means associated with said slide mechanism;

providing pressurized fluid biasing of said slide mechanism toward the first station; and, providing cam means associated and moveable with said slide body and projecting therefrom in position to engage said cam follower means associated with said slide mechanism wherein movement of said slide body from its withdrawn position toward its advanced position serves to cause said cam means to engage said cam follower means associated with said slide mechanism and move said slide mechanism in a direction away from the second station to an out-of-the-way position relative to said punch assembly, and movement of said punch assembly from its advanced position toward its withdrawn position serves to disengage said cam means from said cam follower to free said slide mechanism to return to the first station under the influence of said pressurized fluid biasing of said slide mechanism toward the first station.

6. The method as defined in claim 5 wherein the step of moving the slide body along the work axis toward the die to form the blank into a ball is followed by the steps of withdrawing the slide body from the die and along the work axis to return the plunger assembly to its extended position relative to the slide body and to accommodate the transport of a subsequent blank into registry with the work axis;

returning the blank transporting means to the first station; and moving another length of wire into a condition at the first station to be sheared from the remainder thereof.

7. The method of claim 5 wherein said cam means associated and moveable with said slide body initially engages said cam follower means associated with said slide mechanism at such time as said punch assembly engages said blank as said punch assembly moves toward its advanced position, and said cam disengages said cam follower as said punch assembly moves toward its withdrawn position following the formation of the blank into a ball.

8. The method of claim 5 and including the step of providing pressurized fluid biasing of said plunger assembly toward its extended position relative to said slide body.

* * * * *